US008256871B2

(12) United States Patent
Platt

(10) Patent No.: US 8,256,871 B2
(45) Date of Patent: Sep. 4, 2012

(54) VENT FOR AN INKJET PRINTHEAD

(75) Inventor: David Paul Platt, Newberg, OR (US)

(73) Assignee: Xerox Corporation, Norwalk, CT (US)

( * ) Notice: Subject to any disclaimer, the term of this patent is extended or adjusted under 35 U.S.C. 154(b) by 381 days.

(21) Appl. No.: 12/570,018

(22) Filed: Sep. 30, 2009

(65) Prior Publication Data

US 2011/0074863 A1 Mar. 31, 2011

(51) Int. Cl.
*B41J 2/015* (2006.01)
*B41J 2/175* (2006.01)
*B41J 2/17* (2006.01)

(52) U.S. Cl. ..... 347/20; 347/85; 347/97

(58) Field of Classification Search ..... None
See application file for complete search history.

(56) References Cited

U.S. PATENT DOCUMENTS

| | | | | |
|---|---|---|---|---|
| 4,869,390 | A | 9/1989 | Kennedy | |
| 5,289,212 | A | 2/1994 | Carlotta | |
| 5,486,855 | A | 1/1996 | Carlotta et al. | |
| 5,742,312 | A * | 4/1998 | Carlotta | 347/87 |
| 2002/0063759 | A1 | 5/2002 | Hirano et al. | |
| 2002/0149655 | A1 | 10/2002 | Kurata et al. | |
| 2003/0206219 | A1 * | 11/2003 | Fellingham et al. | 347/85 |
| 2004/0051765 | A1 | 3/2004 | Aponte et al. | |

FOREIGN PATENT DOCUMENTS

| | | |
|---|---|---|
| EP | 0 425 254 | 5/1991 |
| EP | 0 684 136 | 11/1995 |

OTHER PUBLICATIONS

Extended European Search Report corresponding to European Patent Application 10179093.9, European Patent Office, Rijswijk, Netherlands, mailed May 2, 2011 (12 pages).
Partial European Search Report corresponding to European Patent Application 10179093.9, European Patent Office, Rijswijk, Netherlands, Jan. 21, 2011 (6 pages).

* cited by examiner

*Primary Examiner* — Stephen Meier
*Assistant Examiner* — Alexander C Witkowski
(74) *Attorney, Agent, or Firm* — Maginot, Moore & Beck, LLP

(57) ABSTRACT

An inkjet printhead has been developed that includes an ink reservoir vent, which prevents ink from exiting the ink reservoir through the vent. The inkjet printhead includes a reservoir, an ink inlet, a vent opening, and a vent member. The reservoir contains a supply of ink and an air space above the supply of ink. The vent member extends from the vent opening and includes a first vent member opening positioned in an air space outside of the reservoir, a second vent member opening positioned in the air space above the supply of ink, and a vent channel configured to couple fluidly the first vent member opening to the second vent member opening. The second vent member opening is positioned within the reservoir to enable the second vent member opening to remain within the air space above the supply of ink regardless of a printhead orientation.

20 Claims, 5 Drawing Sheets

VENT FOR AN INKJET PRINTHEAD

TECHNICAL FIELD

The device and method described below relate to inkjet imaging devices and, more particularly, to printheads in inkjet imaging devices.

BACKGROUND

Inkjet printers form a printed image by ejecting or "jetting" small droplets of liquid ink onto an image receiving surface, such as an intermediate transfer surface or a media substrate. The benefits of inkjet printing include low printing noise, low cost per printed page, and the ability to print "full color" images. Inkjet printers include, among other components, a printhead and a printhead controller. The printhead controller selectively sends ejection signals to the printhead that cause ejectors within the printhead to eject droplets of liquid ink upon an image receiving surface to form at least a portion of a printed image.

In general, inkjet printheads include a plurality of ink ejectors and at least one reservoir for storing a quantity of ink. Monochromatic inkjet printheads may include a single reservoir for containing a single color of ink. Full color inkjet printheads may include a plurality of reservoirs, with each reservoir configured to contain a different color of ink. For instance, a full color inkjet printhead may include four reservoirs with each reservoir containing one of the four colors of ink typically used to generate full color images; namely, cyan, magenta, yellow, and black. The ink ejectors eject very small droplets of the ink onto an image receiving surface. Often, a group of one hundred to six hundred individual ink ejectors are coupled by a manifold to a single ink reservoir. Specifically, a monochromatic printhead may include a single group of ink ejectors fluidly coupled to the single reservoir, while a full color printhead may include a separate group of ink ejectors for each of the reservoirs. Thus, a full color printhead having four reservoirs may have four groups of ink ejectors, each of which is fluidly coupled to a different ink reservoir.

An ink reservoir of an inkjet printhead may include a reservoir vent that permits air to enter and exit the reservoir. The vent allows air to be expelled from the reservoir in response to the reservoir being filled with ink. Additionally, the vent enables air to enter the reservoir as ink is ejected by the ink ejectors. Therefore, ink reservoir vents operate to equalize air pressure within the ink reservoir.

Typically, reservoir vents include a vent opening positioned in a region of the ink reservoir located above a maximum ink level. At times, however, a printer may be moved or repositioned. These movements may allow ink within the reservoir to migrate to the vent opening and be spilled from the reservoir. The spilled ink, as a consequence, is lost for printing and may contact parts of the printer not designed for ink contact. Therefore, more inkjet reservoir venting solutions are desirable.

SUMMARY

An inkjet printhead has been developed that includes an ink reservoir vent, which prevents ink from exiting the ink reservoir through the vent. The inkjet printhead includes a reservoir, an ink inlet, a vent opening, and a vent member. The reservoir contains a supply of ink and an air space above the supply of ink. A plurality of sidewalls, an upper wall, and a lower wall define the reservoir. The ink inlet and vent opening are formed in one of the plurality of sidewalls, the upper wall, and the lower wall. The vent member extends from the vent opening and includes a first vent member opening positioned in an air space outside of the reservoir, a second vent member opening positioned in the air space above the supply of ink, and a vent channel configured to couple fluidly the first vent member opening to the second vent member opening. The second vent member opening is positioned within the reservoir to enable the second vent member opening to remain within the air space above the supply of ink regardless of a printhead orientation.

A printer has been developed that includes a printhead having an ink reservoir vent that prevents ink from exiting the ink reservoir through the vent. The printer includes a printhead and a printhead controller. The printhead selectively ejects ink onto an image receiving surface. The printhead includes a reservoir, an ink inlet, a vent opening, and a vent member. The reservoir contains a supply of ink and an air space above the supply of ink. A plurality of sidewalls, an upper wall, and a lower wall define the reservoir. The ink inlet and vent opening are formed in one of the plurality of sidewalls, the upper wall, and the lower wall. The vent member extends from the vent opening and includes a first vent member opening, a second vent member opening, and vent channel. The first vent member opening is positioned in an air space outside of the reservoir. The second vent member opening is positioned in the air space above the supply of ink. The vent channel is configured to couple fluidly the first vent member opening to the second vent member opening. The second vent member opening is positioned within the reservoir to enable the second vent member opening to remain within the air space above the supply of ink regardless of a printhead orientation. The printhead controller is coupled to the printhead for controlling the ejection of ink from the printhead.

A method has also been developed of venting a printhead in a printer that prevents ink from exiting an ink reservoir through the vent. The method includes inserting a vent member having a first vent member opening and a second vent member opening fluidly coupled by a vent member channel into a vent opening in an ink reservoir. The method also includes positioning the vent member to locate the first vent member opening in an air space outside of the reservoir. Additionally, the method includes positioning the vent member to locate the second vent member opening at a position that enables the second vent member opening to remain in an air space above a supply of ink contained by the reservoir regardless of a printhead orientation.

BRIEF DESCRIPTION OF THE DRAWINGS

The foregoing aspects and other features of the present disclosure are explained in the following description, taken in connection with the accompanying drawings.

DETAILED DESCRIPTION

The vent described herein is suitable for use with a printer. The term "printer" refers, for example, to reproduction devices in general, such as printers, facsimile machines, copiers, and related multi-function products. While the specification focuses on an inkjet printer, the vent described herein may be used with any printer that contains a supply of ink. Furthermore, the vent described herein may be used with printers that form printed images with either aqueous ink or phase change ink.

Figure 1:
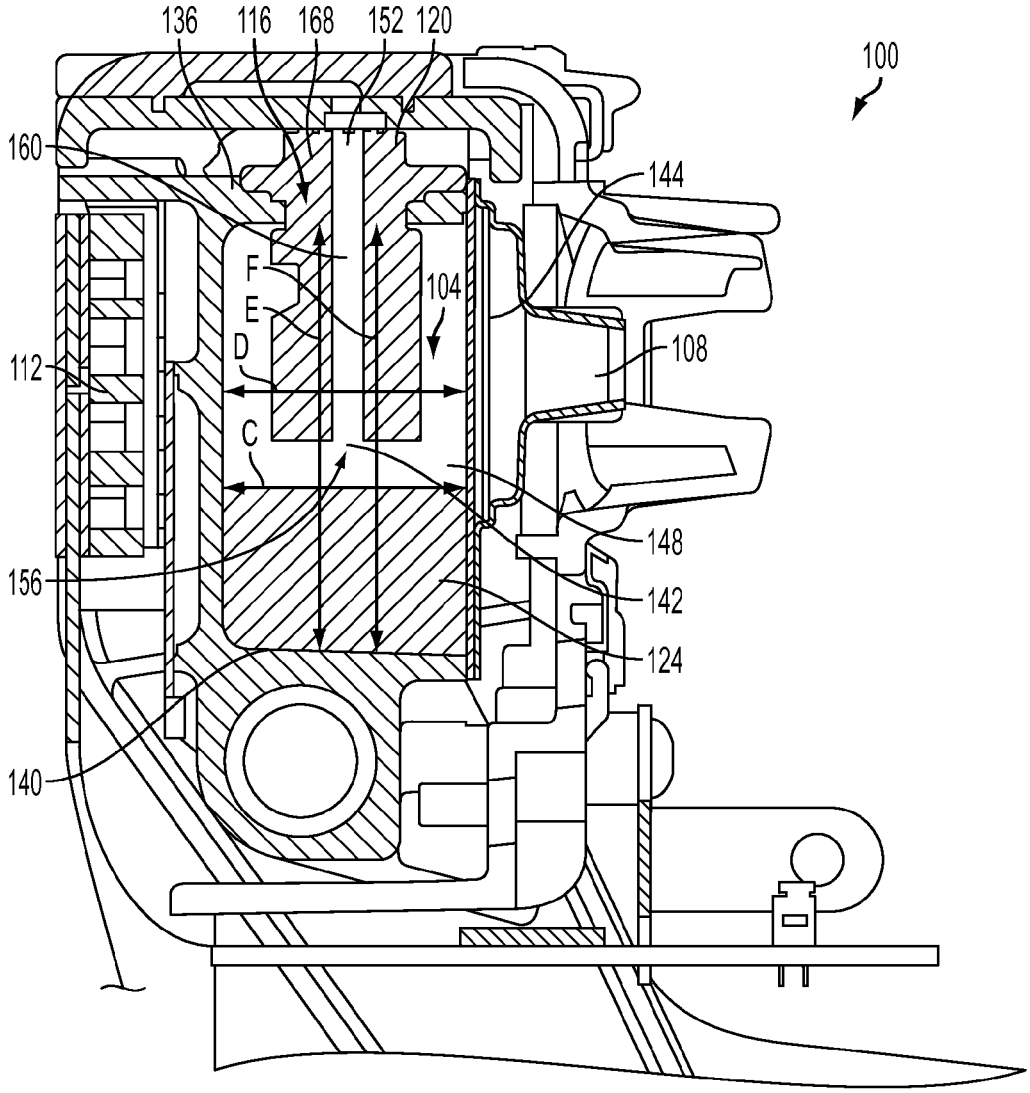
FIG. 1 is a cross sectional view of an inkjet printhead having a vent as described herein.
Figure 5:
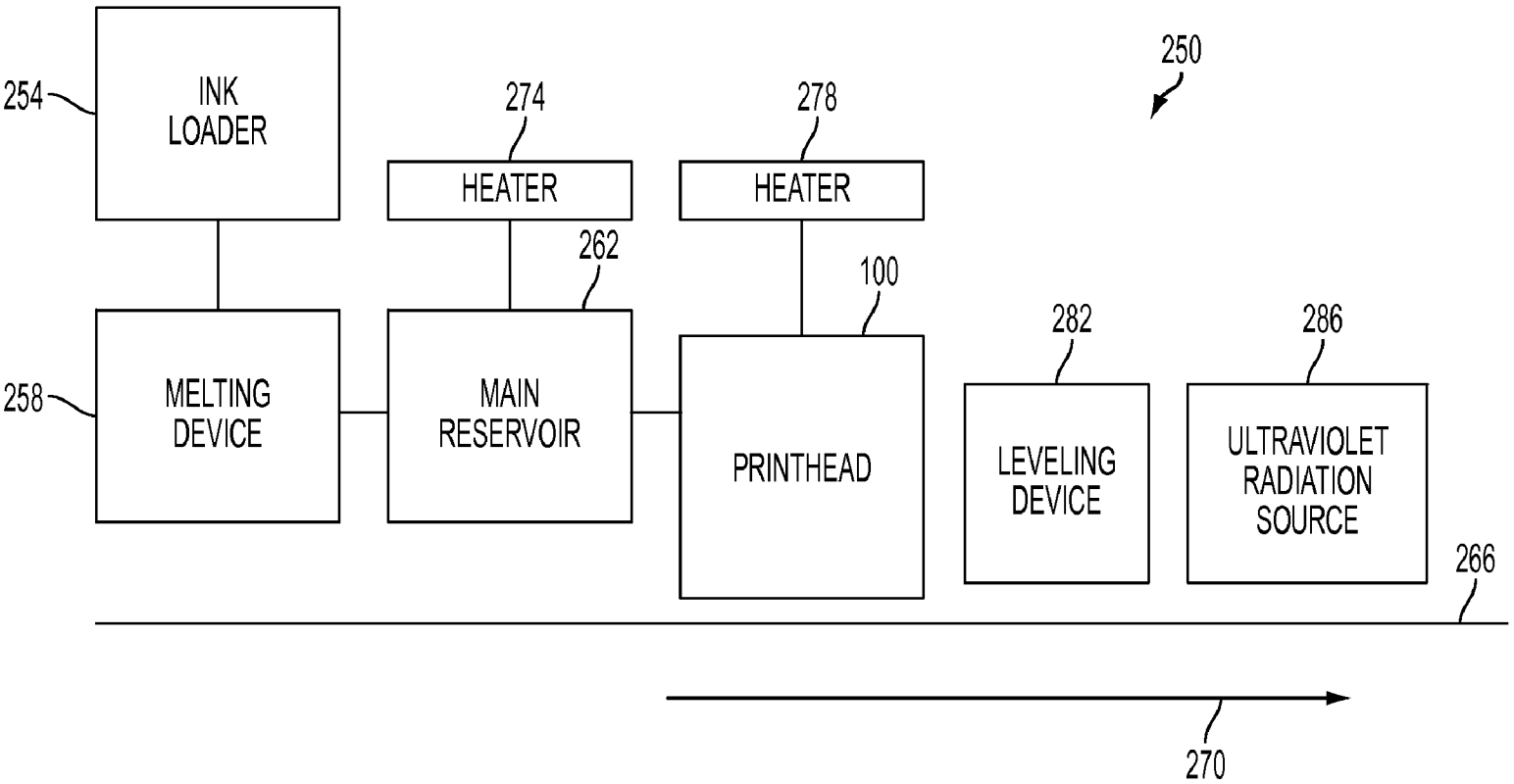
FIG. 5 is a block diagram depicting a side view of a phase change ink printing system having the printhead of FIG. 1.

Referring to FIG. 1, a printhead 100 of an inkjet printer is shown. The printhead 100 forms a printed image by ejecting droplets of liquid ink onto an image receiving surface. As used herein, the term "liquid ink" includes, but is not limited to, aqueous inks, liquid ink emulsions, pigmented inks, and phase change inks in a liquid phase. The printhead 100 includes, among other components, a reservoir 104, an ink inlet 108, numerous ink ejectors 112, a vent opening 116, and a vent member provided herein as a vent tube 120. The reservoir 104 contains a supply of ink 124 for ejection onto the image receiving surface by the ink ejectors 112, which may be provided as thermal ink ejectors and/or piezoelectric ink ejectors, as is known in the art. When the ink ejectors 112 reduce the supply of ink 124 to a minimum ink level, the reservoir 104 may be filled with additional ink via the ink inlet 108, which is fluidly coupled to a main reservoir 262 (FIG. 5). As the ink level in the reservoir 104 fluctuates, the vent tube 120, which extends into the reservoir 104 through the vent opening 116, permits air to enter and exit the reservoir 104. Below, each component of the aforementioned inkjet printhead 100 is described in detail.

Figure 2:
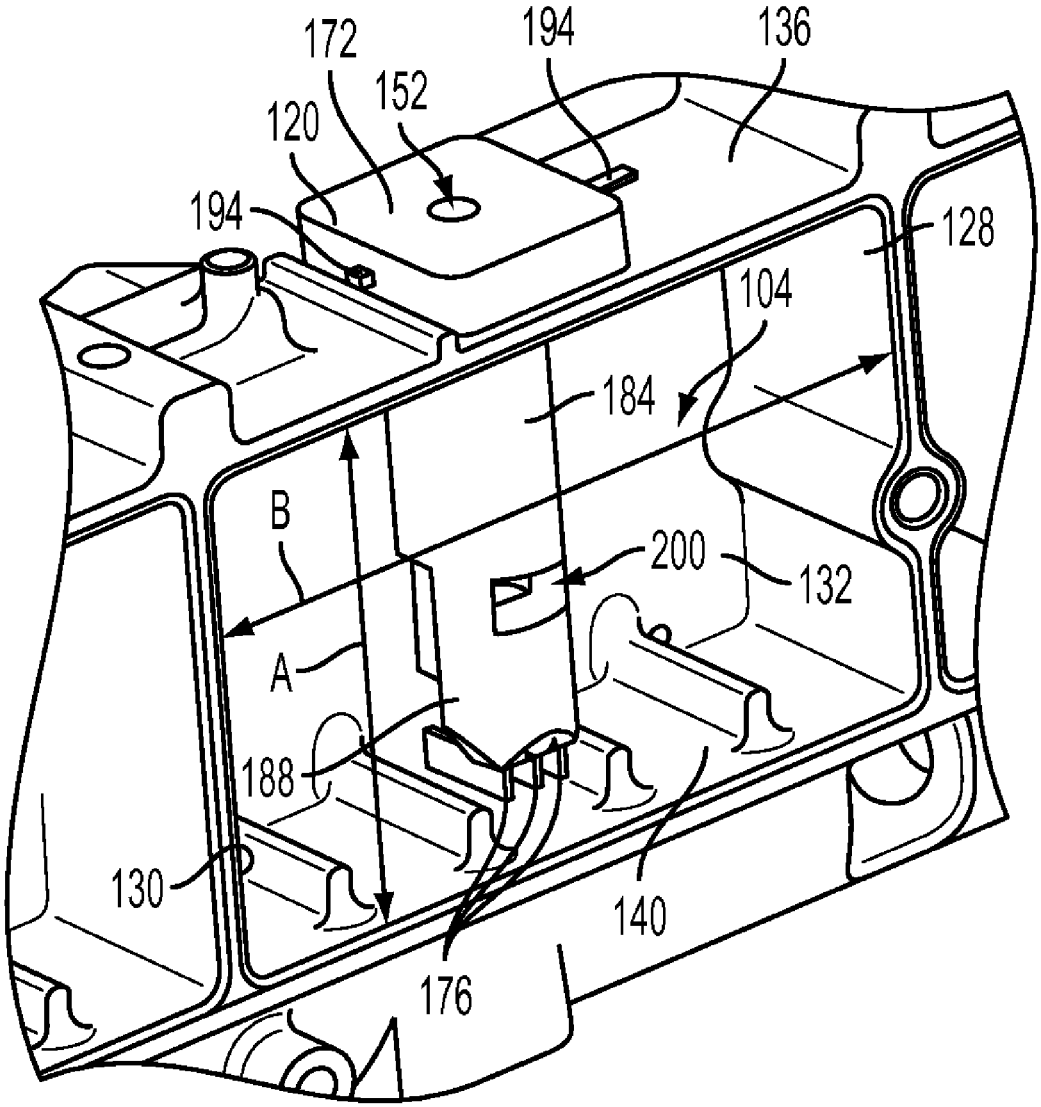
FIG. 2 is a perspective cross sectional view of an ink reservoir in an inkjet printhead having a vent as described herein.

The ink reservoir 104 may include a first pair of opposed sidewalls 128, 130, a second pair of opposed sidewalls 132 (only one of which is shown in FIG. 2), an upper wall 136, and a lower wall 140 that define a volume for containing the supply of ink 124. As shown by length A of FIG. 2, a reservoir height may be defined by a distance between the upper wall 136 and the lower wall 140. Additionally, as shown by length B of FIG. 2, a reservoir width may be defined by a distance between sidewall 128 and sidewall 130. Although the reservoir 104 illustrated in FIGS. 1-3 has a rectangular cross section, the reservoir 104 may have a cross section of any shape suitable for containing the supply of ink 124, including, but not limited to, square, circular, and elliptical. Therefore, in some embodiments the upper wall 136, lower wall 140, and sidewalls 128, 130, 132 may not be sharply delineated. Additionally, as shown in FIG. 1, the ink reservoir 104 may define a volumetric center 142. A plane extending through the volumetric center 142 divides the reservoir 104 into two regions having approximately the same volume.

The ink inlet 108 is formed in one or more of the reservoir walls. As mentioned above, the ink inlet 108 is fluidly coupled to the main reservoir 262. When the supply of ink 124 in the reservoir 104 has dropped to or below a minimum value, the reservoir 104 receives ink from the main reservoir 262 through the ink inlet 108 until the reservoir 104 has been filled to a predetermined maximum ink level, represented by Line C of FIG. 1. The ink inlet 108 may include a filter or screen 144 to prevent impurities from entering the ink reservoir 104.

The reservoir walls 128, 130, 132, 136, 140 and the upper surface of the supply of ink 124 define an air space 148 above the supply of ink 124. As mentioned above, the reservoir 104 may be filled to a predetermined maximum ink level. When the reservoir 104 is filled to the maximum ink level, a volume of air is present above the upper surface of the supply of ink 124. This volume of air is referred to as the air space 148. As shown in FIG. 1, the lower boundary of the air space 148 is defined by the upper surface of the supply of ink 124, and the upper boundary of the air space 148 is defined by the upper wall 136. Depending on the shape of the reservoir 104 and the orientation of the printhead 100, however, the upper boundary of the air space 148 may be defined by any of the reservoir walls 128, 130, 132, 136, 140. For instance, if the printhead 100 is positioned upon a sloped surface the upper boundary of the air space 148 may be defined partially by sidewall 128 and partially by the upper wall 136. Additionally, if the printhead is oriented in an extreme position, the upper boundary of the air space 148 may be defined entirely, for instance, by sidewall 128 or even lower wall 140. Therefore, the portion of the reservoir 104 defining the upper boundary of the air space 148 depends upon the orientation of the printhead 100.

Figure 3:
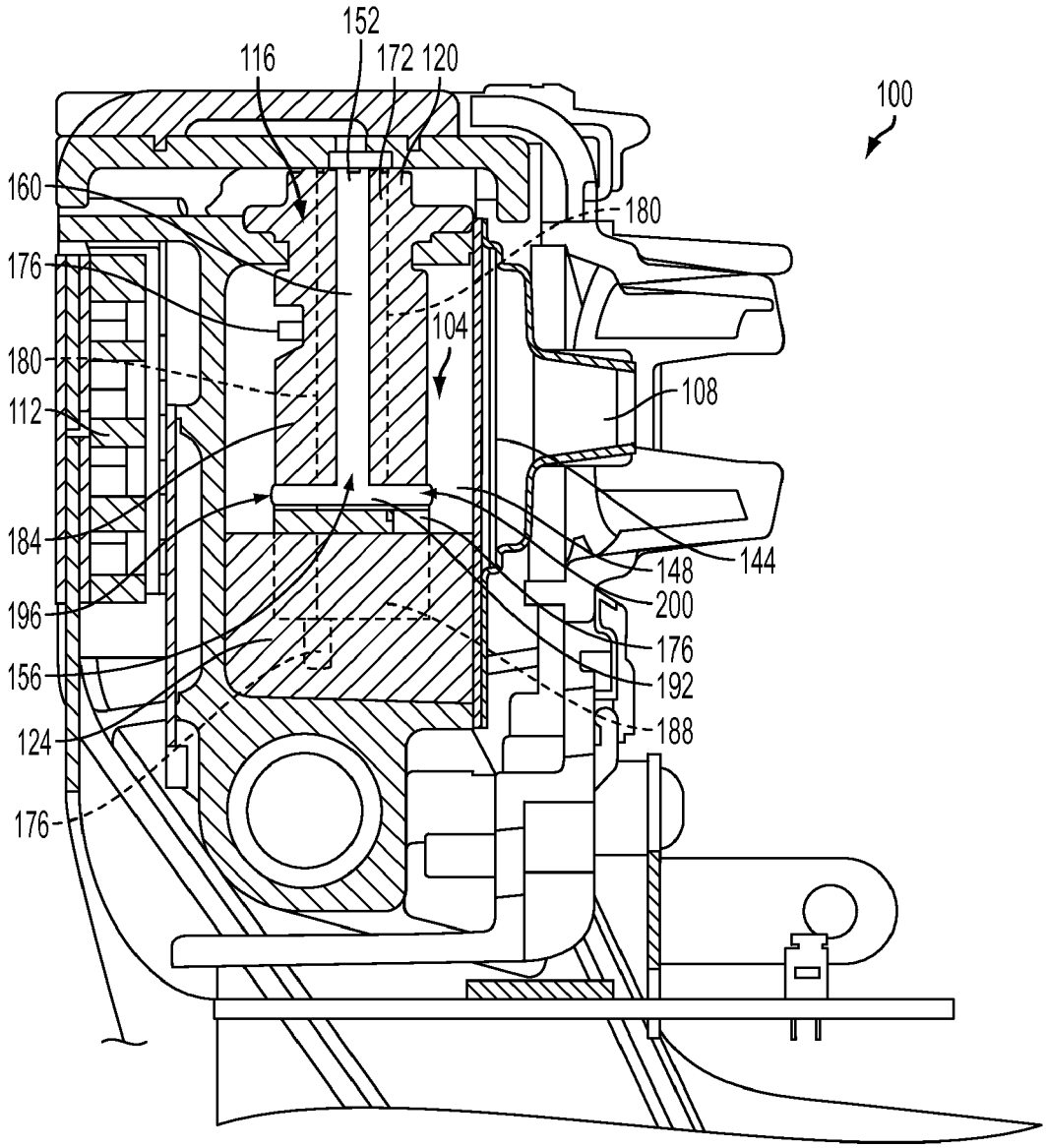
FIG. 3 is a cross sectional view of the inkjet printhead of FIG. 1 having a vent as described herein.

The vent opening 116 in the ink reservoir 104 is an aperture formed in one or more of the reservoir walls 128, 130, 132, 136, 140 that permits a portion of the vent tube 120 to extend into the ink reservoir 104. As shown in FIGS. 1 and 3, the vent opening 116 has been formed in the upper wall 136; however, the opening 116 may be formed in any one or more of the reservoir walls 128, 130, 132, 136, 140. The vent opening 116 engages the vent tube 120 to form an air and liquid impervious seal, which prevents ink from seeping out of the reservoir 104 through the junction between the vent tube 120 and the vent opening 116. For instance, the vent opening 116 may define an approximately circular opening to engage a vent tube 120 having an approximately circular periphery. Alternatively, the vent opening 116 may define a rectangular, square, or elliptical opening to engage a vent tube 120 having an aptly shaped periphery.

The vent tube 120 permits air to enter and exit the reservoir 104, but prevents ink from flowing out of the reservoir 104. As shown in FIGS. 1 and 3, the vent tube 120 extends from the vent opening 116 into the reservoir 104. The vent tube 120 includes an upper opening 152, a lower opening 156, and a channel 160, which fluidly couples the upper opening 152 to the lower opening 156. Although the channel 160, as illustrated in FIGS. 1 and 3, is approximately cylindrical, the channel 160 may be any shape including a non-uniform shape having a nonlinear cross section. The upper opening 152 is an aperture at the top of the channel 160 that, as shown in FIGS. 1-3, is exposed to the atmosphere. In some embodiments, the upper opening 152 may be remotely located by fluidly coupling a channel extension (not illustrated) or other printer accessory to the upper opening 152.

The lower opening 156 is an aperture at the bottom of the channel 160. As shown in FIG. 1, the lower opening 156 is positioned approximately at the volumetric center 142 of the ink reservoir 104, within the air space 148. In particular, the lower opening 156 may be positioned approximately one half of the reservoir height A from the lower wall 140 and one half of the reservoir width B from a sidewall 128, 130. In this position, the lower opening 156 remains in the air space 148 regardless of the orientation of the printhead 100.

Figure 4:
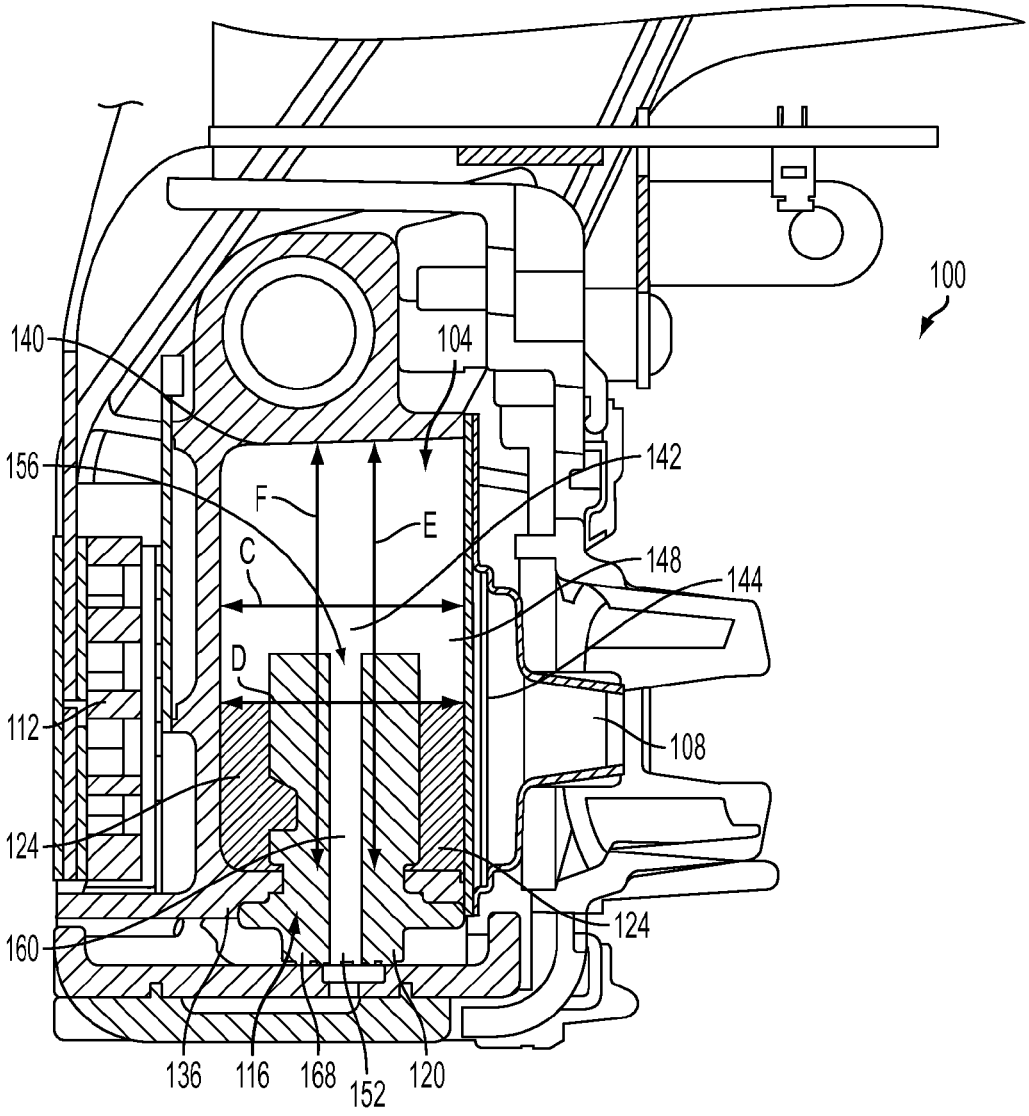
FIG. 4 is a cross sectional view of the inkjet printhead and vent of FIG. 1 shown in an inverted position.

The position of the lower opening 156 prevents the supply of ink 124 from exiting the reservoir 104 through the channel 160. As shown in FIG. 1, the maximum ink level is limited to an amount that enables the lower opening 156 to remain in the air space 148 regardless of the position of the printhead 100. Specifically, the maximum ink level may be slightly less than half of the volume of the reservoir 104, such that when the lower opening 156 is positioned at or near the volumetric center 142 it does not contact the supply of ink 124 regardless of the orientation of the printhead 100. To illustrate, lines C, D, E, and F of FIG. 1 identify the maximum ink level when the printhead 100 is oriented in various extreme positions. In particular, line C identifies the upper surface of the supply of ink 124 when the printhead 100 is in an upright position. Lines E and F identify the upper surface of the supply of ink 124 when the printhead 100 is laterally oriented. Line D identifies the upper surface of the supply of ink 124 when the printhead 100 is inverted, as shown in FIG. 4. In response to the printhead 100 being in an inverted position the supply of ink 124 may surround a portion of the vent tube 120; however, the upper surface of the supply of ink 124 remains below the lower opening 156 to prevent the supply of ink 124 from flowing through the channel 160.

Consequently, regardless of the position of the printhead 100, a buffer of air is present between the upper surface of the supply of ink 124 and the lower opening 156 to prevent the supply of ink 124 from entering the channel 160 and exiting the reservoir 104 through the vent tube 120. Specifically, the lower opening 156 remains in the air space 148 in response to the printhead 100 being rotated about any axis of rotation. For instance, the lower opening 156 remains in the air space 148 as the printhead 100 is transitioned between the upright position of FIG. 1 and the inverted position of FIG. 4.

The vent tube 120 prevents ink from impeding an airflow through the channel 160 if the supply of ink 124 contacts the lower opening 156. As stated above, regardless of the position of the printhead 100, the lower opening 156 remains in the air space 148; however, if the printhead 100 is subject to a severe jostling or extreme vibrations, the supply of ink 124 may briefly contact the lower opening 156. To prevent ink from forming a meniscus across the lower opening 156 that prevents air from flowing through the channel 160, the lower opening 156 has a width or diameter in excess of a predetermined value. The predetermined value is at least partially determined by the surface tension of the ink. In particular, ink having a high surface tension results in a greater predetermined value as compared to an ink having a low surface tension.

As shown in FIG. 1, the vent tube 120 may include an upper extension 168, which extends from the vent opening 116 above the upper wall 136. The upper extension 168 may be coupled to a second tube (not illustrated) in order to locate the upper opening 152 remotely.

The vent tube 120 may be incorporated within a sensor probe 172 removably connected to the vent opening 116. As shown in FIG. 2, a sensor probe 172 having a vent tube 120 may position at least one sensor 176 within the volume of the reservoir 104. The sensor 176 may generate one or more signals indicative of the level of ink in the reservoir 104. For instance, the sensor probe 172 may position a sensor 176 to detect when the supply of ink 124 has reached a minimum or a maximum level. Additionally, the sensor probe 172 may position a sensor 176 to detect the level of ink in the reservoir 104 over a continuous range. Alternatively, the sensor probe 172 may position a sensor 176 above the maximum level of ink to detect a temperature of the air space 148.

The sensor probe 172 may also position a component of a multipart sensor, referred to as a sensing element, within the reservoir 104. The sensing element or elements may generate one or more signals indicative of the level of ink in the reservoir 104. For instance, a pair of sensing elements may be positioned within the reservoir 104 to generate a "full" signal when one or more sensing elements are in contact with the supply of ink 124 and to generate a "low" signal when one or more of the sensing elements are not in contact with the supply of ink 124. Additionally, the sensing element or elements may be positioned to detect the level of ink in the reservoir 104 over a continuous range.

The sensor probe 172 includes at least one channel 180 (as shown in FIG. 3), an upper portion 184, a lower portion 188, and in some embodiments a cross channel 192 (as shown in FIG. 3). The at least one channel 180 enables the one or more sensing elements or sensors 176 to be positioned within the sensor probe 172. As shown in FIG. 3, the channels 180 may originate in the upper portion 184 and terminate at or near a peripheral portion of the sensor probe 172. The channels 180 permit wires or leads 194 electrically coupled to a sensing element or a sensor 176 to extend from the ink reservoir 104 without contacting the supply of ink 124 or the air space 148. The channels 180 are isolated from channel 160 and the cross channel 192.

The cross channel 192 is formed at the interface of the upper portion 184 and the lower portion 188 of the sensor probe 172. The cross channel 192 fluidly couples the lower opening 156 to the air space 148. As shown in FIG. 3, the cross channel 192 is approximately perpendicular to channel 160. Embodiments of the sensor probe 172 having a cross channel 192 include effective lower openings 196, 200 at the ends of the cross channel 192 near the periphery of the vent tube 120. One or more of these effective lower openings 196, 200 and the lower opening 156 remain in the air space 148 regardless of the orientation of the printhead 100. For instance, even though the printhead 100 may be oriented to position effective lower opening 196 in contact with the supply of ink 124, effective lower opening 200 and lower opening 156 remain above the upper surface of the supply of ink 124 in the air space 148, to prevent ink from spilling from the reservoir 104 through the channel 160.

In some embodiments, the vent tube 120 may fluidly couple the reservoir 104 to the atmosphere. In other embodiments, the vent tube 120 may fluidly couple the reservoir 104 to an air pressure device (not illustrated) that selectively couples the air space 148 to one of the atmosphere, a source of air pressure greater than atmospheric pressure, and a source of air pressure lower than atmospheric pressure. The printhead 100 may include a coupling tube (not illustrated) for connecting the air pressure device to the upper opening 152. The air pressure device may maintain either a positive or negative pressure within the reservoir 104. Even when the air pressure device is coupled to the reservoir 104, the vent tube 120 permits air pressure levels within the reservoir 104 to fluctuate as ink is filled and ejected from the reservoir 104.

The vent tube 120 may be coupled to a printhead 100 configured to form printed images with phase change ink. As shown in FIG. 5, a phase change ink printer 250 may include an ink loader 254, a melting device 258, a main reservoir 262, and a media path 270. The printer 250 ejects phase change ink upon an image receiving surface or a substrate 266 transported on a media path 270. The term "phase change ink" encompasses inks that are installed in the printer 250 in a first phase or state and that are ejected upon a substrate 266 after changing to a second phase or state. The change to a second phase or state may include, but is not limited to, changing from a solid to a liquid, changing from a gel to a liquid, and changing from a high viscosity to a low viscosity. As used herein, the term "solid" phase change ink refers to inks that remain in a solid phase at an ambient temperature and that melt into a liquid phase when heated above a melt temperature. The ambient temperature is the temperature of the air surrounding the printer 250. Therefore, the ambient temperature may be a room temperature when the printer 250 is positioned in a defined space; however, the ambient temperature may be above a room temperature when portions of the printer 250, such as the media path 270, are enclosed by, for example, a cover. An exemplary range of melt temperatures is approximately seventy to one hundred forty degrees Celsius; however, the melt temperature of some types of solid phase change inks may be above or below the exemplary temperature range. Similarly, as used herein, the term "gel based" phase change ink or "gel ink" refers to inks that remain in a gelatinous phase or state at an ambient temperature and that melt into a liquid phase when heated above a gelation or melt temperature. An exemplary range of gelation temperatures is approximately thirty to fifty degrees Celsius; however, the gelation temperature of some types of gel-based phase change inks may be above or below the exemplary temperature range.

Some inks, including gel inks, may be cured during the printing process. Radiation curable ink becomes cured after being exposed to a source of radiation. Suitable radiation includes, but is not limited to, infrared, visible, and ultraviolet. In particular, ultraviolet-curable gel based phase change ink, referred to herein as UV gel ink, becomes cured after being exposed to ultraviolet radiation.

The ink loader 254 contains a quantity of phase change ink in the solid or gelatinous phase. Phase change ink is supplied to the ink loader 254 as solid ink pellets, solid ink sticks, or a quantity of gel-based ink, among other forms. The ink loader 254 moves the phase change ink toward the melting device 258, which melts a portion of the ink into the liquid phase. The liquid ink is delivered to the main reservoir 262, which is thermally coupled to a heater 274 configured to heat the main reservoir 262 to a temperature that maintains the ink in the liquid phase. Liquid ink from the main reservoir 262 is delivered to the printhead 100. In particular, the ink is delivered to the ink reservoir 104 through ink inlet 108, as shown in FIGS. 1, 3, and 4. The printhead 100 may include a heater 278 for maintaining the ink contained by the ink reservoir 104 in the liquid phase.

The main reservoir 262 and the ink reservoir 104 may be configured to remain coupled to the printer 250 during normal usage and servicing of the printer 250. Specifically, when the ink level in the ink reservoir 104 falls below a predetermined level, the printer 250 refills the ink reservoir 104 with liquid ink from the main reservoir 262. Similarly, when the ink level in the main reservoir 262 falls below a predetermined level, the printer 250 is configured to fill the main reservoir 262 with additional ink from the ink loader 254. Accordingly, in one embodiment, neither the main reservoir 262 nor the ink reservoir 104 are disposable units configured to be replaced when the printer 250 exhausts an ink supply.

The printer 250 may be configured to form printed images with UV gel ink. UV gel ink remains in a gelatinous state or phase having a comparatively high viscosity at the ambient temperature. When heated to or above the melt temperature, however, the viscosity of UV gel ink is reduced, and the ink enters a liquid phase that is suitable for ejection by the printhead 112. As illustrated in FIG. 5, a printer 250 configured to eject UV gel ink may include a leveling device 282 and a source of ultraviolet radiation 286. The leveling device 282 is configured to blend droplets of UV gel ink, and other types of ink, into a substantially continuous area. In particular, the leveling device 282 may be a thermal reflow device configured to heat the ink ejected upon the substrate 114 to a temperature, which blends together ink droplets of the ink. Additionally or alternatively, the UV gel ink ejected upon the substrate 266 may be exposed to the source of ultraviolet radiation 286, which is configured to cure the ink.

The vent tube 120, when coupled to a phase change ink printer 250 enables air, or other gases, to enter and exit the air space 148 in response to temperature changes of the ink 124. In particular, the vent tube 120 permits air to escape the air space 148 as ink in the reservoir 104 is heated. Additionally, the vent tube 120 permits air to enter the air space 148 in response to the ink in the reservoir 104 cooling.

Those skilled in the art will recognize that numerous modifications may be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An inkjet printhead for selectively ejecting ink onto an image receiving surface, the inkjet printhead comprising:

a reservoir for containing a supply of ink and an air space above the supply of ink, the reservoir defined by a plurality of sidewalls, an upper wall, and a lower wall;

an ink inlet formed in one of the plurality of sidewalls, the upper wall, and the lower wall;

a vent opening formed in one of the plurality of sidewalls, the upper wall, and the lower wall; and a vent member extending from the vent opening, the vent member having a first vent member opening positioned in an air space outside of the reservoir, a second vent member opening positioned in the air space above the supply of ink, and a vent channel configured to couple fluidly the first vent member opening to the second vent member opening, the second vent member opening being positioned within the reservoir to enable the second vent member opening to remain within the air space above the supply of ink regardless of an orientation of the reservoir.

2. The inkjet printhead of claim 1, the vent member being a tube removably connected to the vent opening.

3. The inkjet printhead of claim 1, the vent member being located within a sensor probe, the sensor probe being removably connected to the vent opening, and the sensor probe having at least one channel for positioning at least one sensing element within the reservoir.

4. The inkjet printhead of claim 3, the sensor probe further comprising:

a first ink sensing element extending through a first channel; and a second ink sensing element extending through a second channel, the first and second ink sensing elements configured to generate at least one signal indicative of a level of ink contained by the reservoir.

5. The inkjet printhead of claim 3, the sensor probe further comprising:

a first sensor probe portion;

a second sensor probe portion; and a cross channel formed at an interface of the first sensor probe portion and the second sensor probe portion, the cross channel configured to couple fluidly the second vent member opening to the air space above the supply of ink.

6. The inkjet printhead of claim 1, the second vent member opening having a width configured to prevent a meniscus of ink from forming across the second vent member opening, the width of the second vent member opening at least partially determined by a surface tension of the supply of ink.

7. The inkjet printhead of claim 1, further comprising:

a positive air pressure source fluidly coupled to the first vent member opening, the positive air pressure source configured to apply a purge pressure to the reservoir.

8. The inkjet printhead of claim 1, the second vent member opening located at a volumetric center of the reservoir.

9. The inkjet printhead of claim 1, further comprising:

a reservoir height defined by a distance between the upper wall and the lower wall, the second vent member opening positioned at least one half of the reservoir height from the lower wall; and a reservoir width defined by a distance between a first sidewall and a second sidewall, the second vent member opening positioned approximately one half of the reservoir width from the first sidewall.

10. A printer for forming and fixing an image upon an image receiving surface comprising:

a printhead for selectively ejecting ink onto an image receiving surface, the printhead including (i) a reservoir for containing a supply of ink and an air space above the supply of ink, the reservoir defined by a plurality of sidewalls, an upper wall, and a lower wall, (ii) an ink inlet formed in one of the plurality of sidewalls, the upper wall, and the lower wall, (iii) a vent opening formed in one of the plurality of sidewalls, the upper wall, and the lower wall, and (iv) a vent member extending from the vent opening, the vent member having a first vent member opening positioned in an air space outside of the reservoir, a second vent member opening positioned in the air space above the supply of ink, and a vent channel configured to couple fluidly the first vent member opening to the second vent member opening, the second vent member opening being positioned within the reservoir to enable the second vent member opening to remain within the air space above the supply of ink regardless of an orientation of the printhead; and a printhead controller coupled to the printhead for controlling the ejection of ink from the printhead.

11. The printer of claim 10, the vent member being a tube removably connected to the vent opening.

12. The printer of claim 10, the vent member being located within a sensor probe, the sensor probe being removably connected to the vent opening, and the sensor probe having at least one channel for positioning at least one sensing element within the reservoir.

13. The printer of claim 12, the sensor probe comprising:

a first sensor probe portion;

a second sensor probe portion; and a cross channel formed at an interface of the first sensor probe portion and the second sensor probe portion, the cross channel configured to couple fluidly the second vent member opening to the air space above the supply of ink, the cross channel being approximately perpendicular to the vent channel.

14. The printer of claim 10, the second vent member opening having a width configured to prevent a meniscus of ink from forming across the second vent member opening, the width of the second vent member opening at least partially determined by a surface tension of the supply of ink.

15. The printer of claim 10 further comprising:

a positive air pressure source fluidly coupled to the first vent member opening, the positive air pressure source configured to apply a purge pressure to the reservoir.

16. A method of venting an ink reservoir in a printhead of an inkjet printer comprising:

inserting a vent member having a first vent member opening and a second vent member opening fluidly coupled by a vent member channel into a vent opening in an ink reservoir; and positioning the vent member to locate the first vent member opening in an air space outside of the ink reservoir and to locate the second vent member opening at a position within the reservoir that enables the second vent member opening to remain in an air space above a supply of ink contained by the ink reservoir regardless of an orientation of the ink reservoir.

17. The method of venting an ink reservoir in a printhead of an inkjet printer of claim 16, the vent member being a tube removably connected to the vent opening.

18. The method of venting an ink reservoir in a printhead of an inkjet printer of claim 16, the vent member being located within a sensor probe removably connected to the vent opening, the sensor probe having at least one channel for positioning at least one sensor within the ink reservoir.

19. The method of venting an ink reservoir in a printhead of an inkjet printer of claim 16, the second vent member opening having a width configured to prevent a meniscus of ink from forming across the second vent member opening, the width at least partially determined by a surface tension of the supply of ink.

20. The method of venting an ink reservoir in a printhead of an inkjet printer of claim 16, further comprising:

fluidly coupling a source of positive air pressure to the first vent member opening, the source of positive air pressure configured to apply a purge pressure to the ink reservoir.

* * * * *